US009439511B2

(12) United States Patent
Hickman

(10) Patent No.: US 9,439,511 B2
(45) Date of Patent: Sep. 13, 2016

(54) HANGABLE ARTIST'S EASEL AND ACCESSORIES

(71) Applicant: Robert W. Hickman, Lexington, SC (US)

(72) Inventor: Robert W. Hickman, Lexington, SC (US)

( * ) Notice: Subject to any disclaimer, the term of this patent is extended or adjusted under 35 U.S.C. 154(b) by 0 days.

(21) Appl. No.: 14/776,502

(22) PCT Filed: Jan. 15, 2014

(86) PCT No.: PCT/US2014/011625
§ 371 (c)(1),
(2) Date: Sep. 14, 2015

(87) PCT Pub. No.: WO2014/158313
PCT Pub. Date: Oct. 2, 2014

(65) Prior Publication Data

US 2016/0029799 A1 Feb. 4, 2016

Related U.S. Application Data

(63) Continuation of application No. 13/802,783, filed on Mar. 14, 2013, now Pat. No. 8,870,148.

(51) Int. Cl.
*A47B 97/04* (2006.01)
*A47B 97/06* (2006.01)
*A47B 97/08* (2006.01)

(52) U.S. Cl.
CPC ..... *A47B 97/06* (2013.01); *A47B 97/04* (2013.01); *A47B 97/08* (2013.01)

(58) Field of Classification Search
None
See application file for complete search history.

(56) References Cited

U.S. PATENT DOCUMENTS 2,235,367 A * 3/1941 Heausler ..... A47B 23/007 248/444.1
2,925,916 A * 2/1960 Pollock ..... A47B 1/02 211/119.004
3,095,834 A * 7/1963 Killen ..... A47B 85/06 108/1
3,231,230 A * 1/1966 Mueller ..... A47B 97/04 248/357
4,239,170 A * 12/1980 Planebo ..... A47B 97/001 248/447.1
4,258,893 A * 3/1981 Tolley ..... F16M 13/00 108/28
4,846,430 A * 7/1989 Ke ..... A47G 29/00 211/119.004
5,791,623 A * 8/1998 Louridas ..... A47B 97/08 248/168
5,950,979 A * 9/1999 Mira ..... A47B 97/08 248/449
6,471,174 B2 * 10/2002 Turner ..... A47B 97/04 248/444
6,601,805 B1 * 8/2003 Kapp ..... A47B 97/08 248/171
7,178,769 B2 * 2/2007 Magnusson ..... A47B 96/1416 211/119.004
7,934,958 B2 * 5/2011 Kendall ..... F25D 23/028 439/628
2010/0270246 A1 * 10/2010 Rodriguez ..... A47B 96/16 211/34
2012/0080580 A1 * 4/2012 Densberger ..... A47B 97/04 248/448

* cited by examiner

*Primary Examiner* — Bradley Duckworth
(74) *Attorney, Agent, or Firm* — Jonathan A. Kidney; TechLaw LLP

(57) ABSTRACT

A space saving, door or wall-mountable artist's easel with a framework adapted to receive and hold an artist's canvas, art panel, clipboard, or some other item that would normally be affixed to an easel with a mounting bracket attached to the frame so the entire device may be hung on a door or wall. The easel can be used while mounted. In one example, a front pivoting frame enables the mounted piece to be extended outward from a back stationary frame. A height adjustment mechanism allows the mounted piece to be raised or lowered to a desired position, enabling the artist to stand or sit. The compactness of the easel enables an art piece being worked on to be left mounted to the easel for drying or viewing, and the door can still be opened and closed normally with the easel mounted to it.

15 Claims, 19 Drawing Sheets

HANGABLE ARTIST'S EASEL AND ACCESSORIES

REFERENCE TO PRIORITY APPLICATION(S)

This national stage entry application claims priority to and the benefit thereof PCT application no PCT/US14/11625 filed Jan. 15, 2014, claiming priority to U.S. patent application Ser. No. 13/802,783, filed Mar. 14, 2013, now issued as U.S. Pat. No. 8,870,148, the contents of which are hereby incorporated by reference in its entirety.

FIELD OF INVENTION

The invention relates to artist's easels. More particularly, this invention relates to an artist's easel that can be easily mounted or hanged to a door or other non-floor space.

BACKGROUND

Economy artist's easels typically are composed of a three-legged wooden framework, of much the same format as the traditional blackboard easel, that "stand" on the floor via the framework's legs. Higher quality easels typically have a wooden frame with pinned segments that can be moved so that the frame will rest on the floor. For an easel to be stored, it must be folded up and moved off the floor space. Once it has been folded up, the easel is not stable and not in a state that it can be used in an effective manner.

All floor easels have one feature in common: they require floor space while being used, and sometimes even while being stored. If a person does not have enough space to leave the easel set up while not being used, he/she must typically remove the artwork from the easel, fold the easel up, and put it away for storage, as well as find a safe place to store the art panel until ready to work on it again. Having to set-up and take-down the easel is inconvenient, especially in a small studio or work area where floor space is at a premium.

In view of the above, there has been a long standing need in the artist's community for a more "space-friendly" easel. Accordingly, details of a door-mountable artist's easel are elucidated below that obviates many of the above difficulties.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The foregoing needs are met, to a great extent, by the present disclosure, wherein in one aspect of an embodiment, a hangable artist's easel is provided, comprising: at least one frame comprised of at least one substantially vertical support member and at least one substantially horizontal support member, the members being coupled to each other to form a substantially planar, upright supporting structure; a longitudinal, workpiece supporting fixture, having an artist-side face, an opposite side face, a top portion and a bottom portion, and an accommodation for vertical travel of a workpiece securing member, wherein the workpiece supporting fixture is vertically attached to the at least one frame; at least one workpiece securing member, substantially horizontal in orientation having a horizontal face for securing a bottom or top horizontal side of a workpiece placed in the easel, releasably mounted to the artist-side face of the workpiece supporting fixture, being position-adjustable along the accommodation for vertical travel of the workpiece supporting fixture; at least one releasable securing fixture, securing the at least one workpiece securing member to the workpiece supporting fixture; and a mounting mechanism coupled to the at least one frame, to allow the easel to be mounted to a door or wall.

In other aspects of the present disclosure, embodiments of the above easel are described, wherein the at least one frame are two frames, a top portion of a first frame being pivotally coupled to a top portion of a second frame, the first frame having the mounting mechanism and configured to rest against the door or wall; and/or wherein the accommodation for vertical travel is a slot through the workpiece supporting fixture and the releasable securing fixture is a threaded knob over a threaded bolt, the threaded bolt traveling through the slot; and/or wherein the mounting mechanism is a bracket that fits over a top, or corner or side of a door; and/or wherein the mounting mechanism comprises a hole in a top portion of the at least one frame or workpiece supporting fixture, or a plate attached to the at least one frame or workpiece supporting fixture, wherein a nail, screw or hook can be placed to attach the easel to a door or wall; and/or further comprises a tension adjustable strap attached to the mounting mechanism or to the at least one frame that is proximal to the door or wall; and/or wherein the mounting mechanism is attached to a hinge of a door; and/or further comprises at least one pivoting arm pivotally attached to a non-upper portion of the at least one substantially vertical support member, wherein the at least one pivoting arm, when extended from the vertical support member and secured from movement, operates to angle the at least one frame away from the door or wall; and/or further comprises a pivoting arm support, attached to the at least one substantially vertical support member that the at least one pivoting arm is attached to, and height adjustable along the at least one substantially vertical support member, the pivoting arm support having a flat side to contact and support the at least one pivoting arm; and/or further comprises a pivoting arm cushion disposed at an end of the pivoting arm, to cushion the end against the door or wall; and/or further comprises vertically spaced mounting holes or a vertical slot in the at least one substantially vertical support member; and a pivotable tray that is mountable to the holes or slot in the substantially vertical support member; and/or further comprises a removable pastel dust tray, sized to fit between workpiece securing member and the at least one workpiece supporting fixture; and/or further comprises an accessory attachment plate or bar, attached to the workpiece supporting fixture or to the at least one workpiece securing member; and/or further comprises a lamp attached to the attachment plate or bar; and/or wherein the at least one frame and workpiece supporting fixture are made of wood.

DETAILED DESCRIPTION

As described in the following FIGS., various embodiments of an artist's easel are shown comprising a framework adapted to receive and hold an artist's canvas, art panel, clipboard, chalk or dry erase board, or some other item that would normally be affixed to an easel; and is structured so as to allow the entire device to be hung on a door (or wall) in a room, for example, in a home, workplace, or school environment. The mechanism for hanging or attaching can be so that the easel can be easily removed/unhung/unattached without damaging the surface/object it is fixed to.

Because the easel can be "hung," no floor space is needed (while in use and while not in use). The user can simply "store" the easel upon a door or use it while mounted to the door. In some scenarios, the user may move the easel from one door (or wall) to another door (or wall) having more desirable lighting or utility. Accordingly, individuals, who are very space limited such as in a small apartment or dormitory room, will be able to have an easel to work on without giving up any needed floor space. The art piece being worked on can be left mounted to the easel for drying or viewing, and the door can still be opened and closed normally with the easel mounted to it.

While providing space saving, the easel's stability is actually enhanced by being mounted to a door (or wall), understanding that in the case of the door, the door is firmly fixed to the walls of a room via its hinges. Therefore, the easel, and thus the mounted workpiece or artwork, cannot be "accidentally" tipped over as is often experienced with conventional easels, thus preventing damage to the art piece as well as the easel. Because it is mountable, the easel will be of dimensions that allow it to fit on the face of a door. As most doors are 24-30 inches in width, for some embodiments, the easel will generally have a width that does not exceed 20 inches. Of course, for wider doors, the width of the easel in these instances can be increased, according to design preference. Similarly, most doors are 6-7 feet in height, therefore, for some embodiments, the easel will be less than 6-7 feet in height. Of course, for taller or even shorter doors, the height of the easel in these instances can be increased or decreased, according to design preference.

Additionally, in some embodiments, the user can set the working angle of the artwork from a vertical (e.g., folded) up position to a desired viewing/working angle, for example, up to 15 degrees off vertical or more. This ability to adjust the angle makes the easel desirable for artists of all kinds, from pastel users to acrylics and oil users. Further, in embodiments with adjustable positioning, the art being worked on can be positioned so that the user can be seated or standing.

Figure 1:
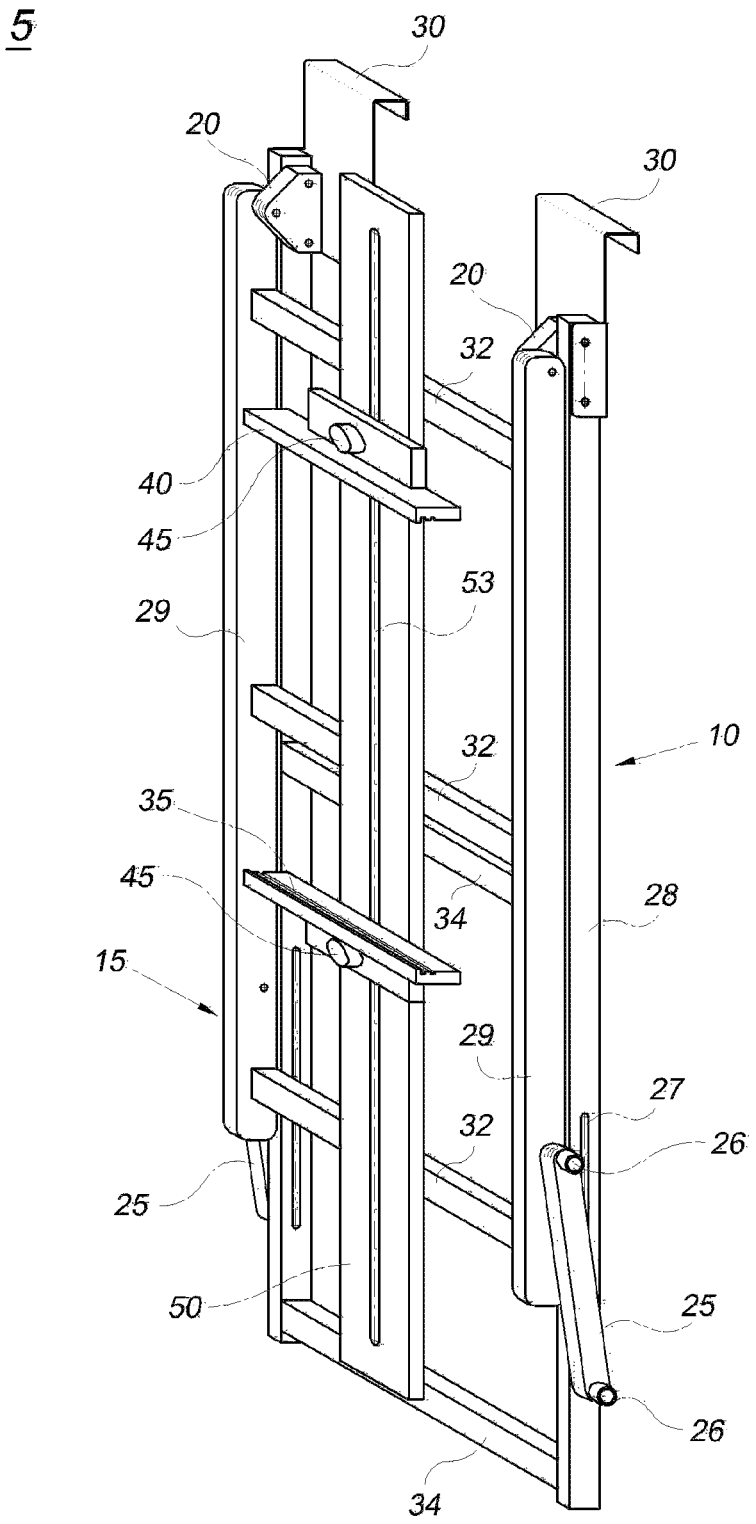
FIG. 1 is an illustration of a perspective view of an embodiment of door-mountable easel in a "closed" state.
Figure 2:
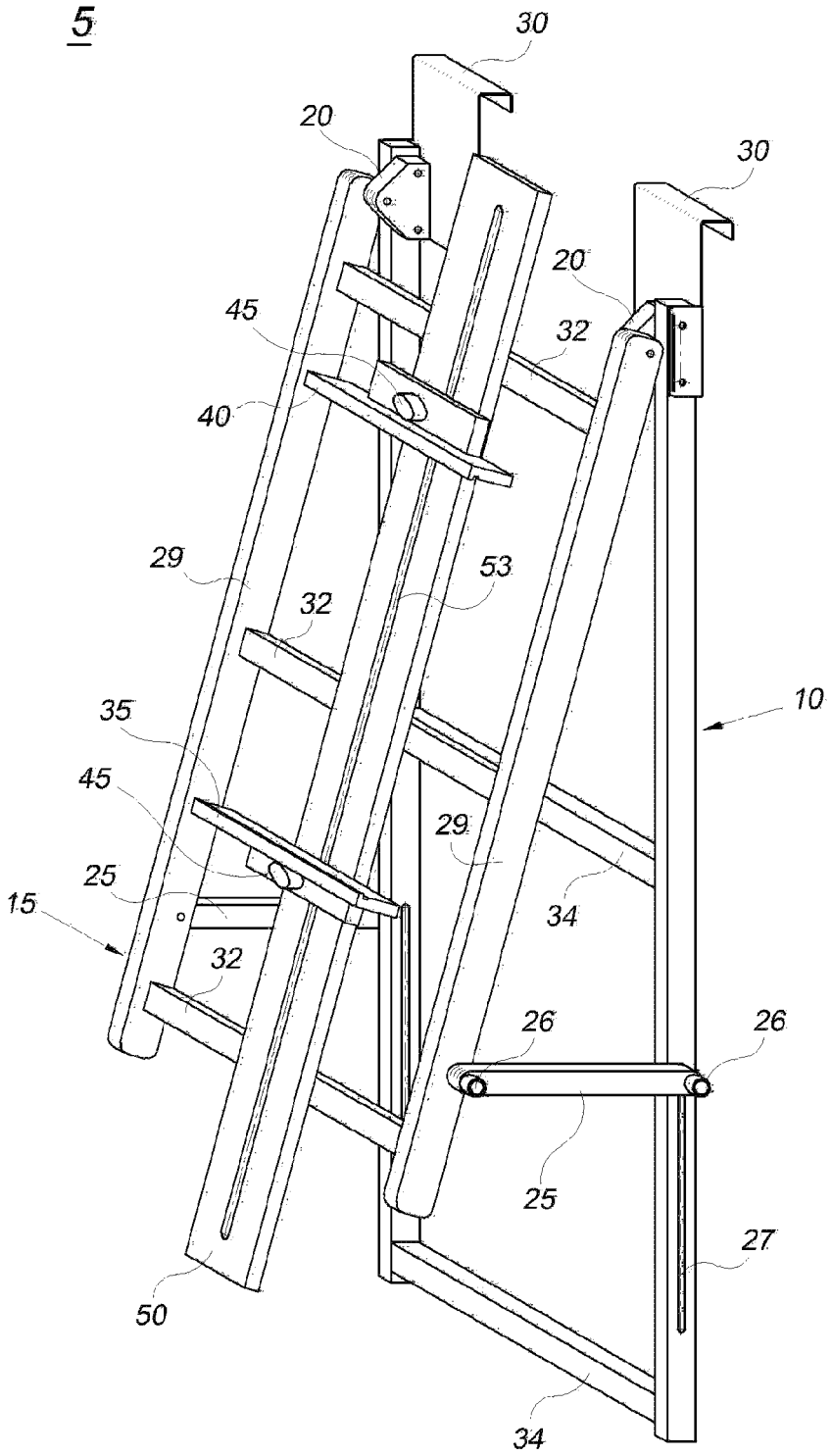
FIG. 2 is an illustration of a perspective view of the embodiment of FIG. 1 in its maximum "open" state.

FIG. 1 is an illustration of a perspective view of a door-hung adjustable easel 5 in a retracted or folded state and FIG. 2 is an illustration of the easel 5 in an extended or open state. The easel 5 is used for supporting an artist's canvas or panel (not shown), as broadly defined, in a generally upright, front-facing positioning, and is understood to be mounted to a door (not shown).

Referring to FIG. 1 and FIG. 2, the easel 5 is formed of a door mounting rear frame 10 and an art work mounting front frame 15, connected by bracket(s) 20 at an upper end of rear frame 10 and front frame 15. Rear frame 10 is formed from vertical member(s) 29 joined by one or more supporting members 34, providing rigidity to rear frame 10. Front frame 15 is formed from vertical member(s) 28 joined by one or more supporting members 32, providing rigidity to front frame 15 and also a platform for attachment of front frame's 15 vertical fixture base 50, as further detailed below.

By use of "skeletal" rear and front frames 10, 15 that are generally planar in nature, significant weight savings can be achieved versus using a solid frame. However, in some embodiments, use of different materials or lighter/stronger materials may obviate the need for a skeletal framing approach and therefore, while the FIGS. illustrate a frame-like "structure," other structures, whether frame-like or not may be utilized without departing from the spirit and scope of this disclosure. For example, rear frame 10 may be a solid structure, as well as front frame 15, thus obviating the need or utility of supporting members 32, 34. Also, if supporting members(s) 32, 34 are used, they may be diagonally positioned or arched or of any configuration or shape that provides support to vertical members 28, 29.

Continuing, bracket(s) 20 is bolted or fastened in a secure manner to rear frame 10 and is joined to front frame 15, typically by a pivot enabling bolt/pin (not shown). Bracket(s) 20 may use a hinge or any other similarly functioning mechanism to secure back frame 10 to front frame 15. Pin/hinge provides the ability for the top portion of front frame 15 to pivot, allowing the bottom portion of front frame 15 to swing "outward" away from a door or wall.

Side link(s) 25 are attached to the bottoms of back frame 10 and front frame 15 to provide support and stability for front frame 15, when in an extended position. One end of side link(s) 25 is "pinned" by a rotatable bolt or link (not shown) to vertical member(s) 29 of front frame 15 and the other end of side link(s) 25 is connected to vertical member(s) 28 of back frame 10 by a bolt/pin (not shown) that may go through a slot 27 in vertical member(s) 28. The travel of side link(s) 25 determines how far front frame 15 is able to be extended out from back frame 10. Therefore, depending on the length of side link(s) 25 (and length of groove 27), various degrees of extension of front frame 15 from back frame 10 can be realized.

It is readily apparent that one of ordinary skill may make changes or modifications to the side link(s) 25 and groove 27 arrangement without departing from the spirit and scope of this disclosure. For example, groove 27 may be disposed on the front member 29 of front frame 10, reversing the arrangement seen. Moreover, while a pin/slot mechanism can be used to control movement of side link(s) 25, other forms of front frame 15 extension control may be used. For example, an arm that "locks" when extended may be used instead of side link(s) 25, or a springing mechanism. Accordingly, it is expressly understood that various modifications that are within the purview of one of ordinary skill in the art are within the scope of this disclosure.

To provide the ability to fix an angle of extension, knob(s) 26, or equivalent for tightening, are disposed on one or more of the bolts/pins that go through side link(s) 25 so that a position of the easel 5 can be locked, providing stability and stiffness to the front frame 15 when extended.

The bracket(s) 30 that is attached to the top of rear frame 10 is shaped so that it can be placed over the top edge of a door (not shown). The size of bracket(s) 30 can be fixed or adjustable, depending on design preference, to enable bracket(s) 30 to "hang" onto the top of a door. It is understood that in a commercial embodiment, bracket(s) 30 may be sized to accommodate the great majority of standard door widths (e.g., thickness). If smaller door thicknesses are present, small shims can be inserted between the door and the bracket(s) 30 to provide a good fit. If the door thickness is too great, then bracket(s) 30 can easily be made to meet the need. In some embodiments, bracket(s) 30 may be detachable from front frame 15 and back frame 10, allowing a user to replace bracket(s) 30 with another bracket(s) that is sized for the thickness of the door of interest.

In other embodiments, bracket(s) 30 may be solely attached to back frame 10, understanding that in the embodiments shown, for example, in FIGS. 1-2, bracket(s) 30 may need to be lengthened to attach to back frame's 10 supporting members 34. Alternatively, one of supporting members 34 may be positioned "higher" on back frame 10 to allow bracket(s) 30 to be easily attached. It is understood, given the numerous different ways that bracket(s) 30 may be attached to back frame 10, changes, modifications, variations to the "attachment" arrangement are understood to be within the scope of one of ordinary skill in the art and are considered to be within the purview of this disclosure. As one non-limiting example, bracket(s) 30 may be adjustable in length, using perhaps an adjustable tension providing strap to form the connection with back frame 10.

Easel 5 is shown in a closed or retracted state (an angle of nearly zero degrees between the rear frame 10 and the front frame 15) in FIG. 1. This position will likely be the position that easel 5 will be stored in while not being used. However, it is understood that some artists such as users of pastel, for example, will want to use the easel 5 in this position.

In addition to side member(s) 29, front frame 15 will have adjustable height bottom artwork fixture 35 and top artwork fixture 40, which slide via rear locking bolts/pins (not shown) traveling in slotted hole 53 in vertical fixture base 50. Vertical fixture base 50 is attached to supporting member(s) 32. Bottom and top artwork fixtures 35,40 are secured or tightened to vertical fixture base 50 via tightening knob(s) 45 connected to rear locking bolts/pins or via sliding plate with tapped hole. Alternative mechanisms for connecting may be used.

In this arrangement, bottom artwork fixture 35 and top artwork fixture 40 can be adjusted to hold an artist's canvas or panel at a suitable working height. Each of bottom and top artwork fixtures 35, 40 are positioned by loosening knob(s) 45 to release the tension on the locking bolts/pins (or plate), moving the respective fixture to the desired height, and then tightening the knob(s) 45. Vertical fixture base 50 can be rigidly affixed to front frame 15 so that the weight of the artist's canvas or panel is sufficiently distributed to the easel 5. It should be understood that in some embodiments, bottom artwork fixture 35 may be stationary, the artwork being placed on stationary bottom artwork fixture 35 and top artwork fixture 40 being lowered to constrain the artwork from movement. Conversely, in some embodiments, it may be designed to where to artwork fixture 40 may be fixed and bottom artwork fixture 35 may be adjustable in height.

While the mechanism for securing an artist's canvas/panel is illustrated as being accomplished via sliding fixtures 35, 40 controlled by slotted hole 53, and tightened by knob(s) 45, other commonly used mechanisms for securing a canvas/panel or adjusting its height and/or location on front frame 15 are understood to be within the purview of one of ordinary skill in the art and are incorporated herein. For example, a pulley system connecting bottom and top artwork fixtures 35, 40 may be used. Or springs pushing against bottom and top artwork fixtures 35, 40 to put pressure on an inserted canvas/panel. Therefore, while the FIGS. show one possible mechanism for securing a canvas/panel and adjusting its height, other mechanisms may be utilized without departing from the spirit and scope of this disclosure.

FIG. 2 is an illustration of the easel 5 of FIG. 1 with front frame 15 in an extended or rotated position. In some embodiments, front frame 15 may be moved from several degrees up to 15 degrees and more, depending on implementation preference. The angle can easily be increased even more by using a longer side link(s) 25 and cutting longer slotted hole 27 in the vertical member(s) 28 of rear frame 10 to allow for the greater travel of the rear locking bolts/pins, or alternatively, by repositioning the holes and slots on vertical members 28, 29.

Front frame 15 can be positioned by the user to hold the artist's canvas/panel at a desired working height by appropriately moving bottom artwork fixture 35 and top artwork fixture 40. As stated above, each top and bottom fixture 35, 40 can be positioned by loosening knob(s) 45 to release the tension on the respective locking bolt, moving the respective fixture to the desired height, and then tightening knob(s) 45.

Figure 3A:
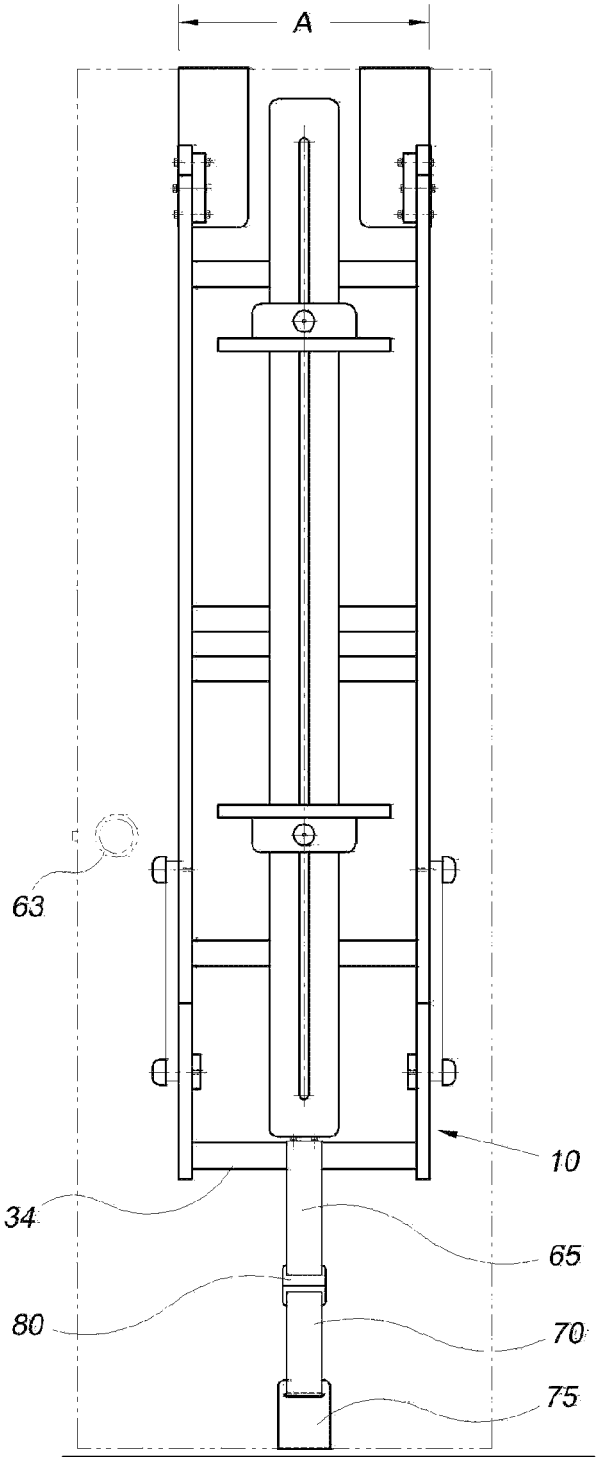
FIGS. 3A-B are illustrations of a front view and side view, respectively of the embodiment of FIG. 1.
Figure 3B:
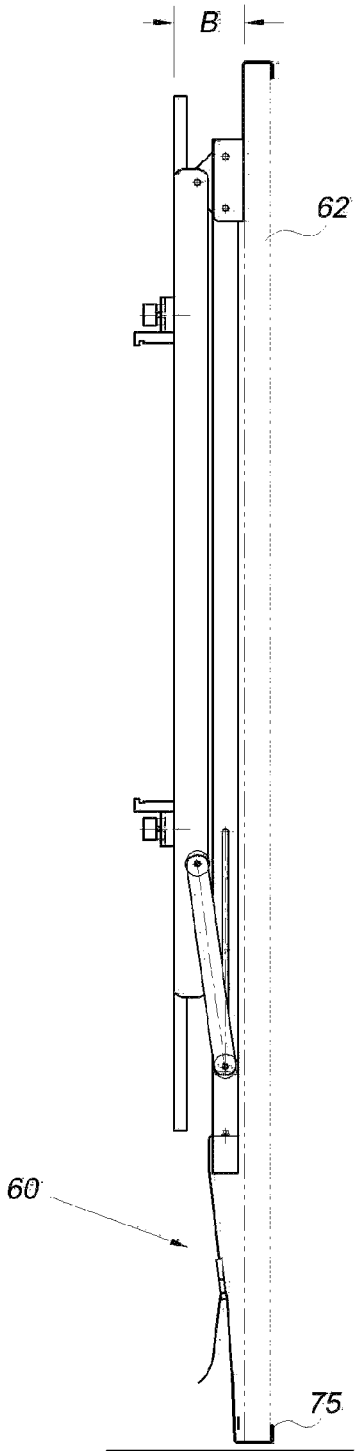

FIGS. 3A-B depict front and side views, respectively, of the easel 5 shown in FIG. 1 as mounted to a door 62. The compact form of easel 5, when in a "closed" state permits normal use of door 62. The easel 5 can be of sufficiently narrow width "A" to allow ample space to grasp the door knob 63 in order to open and close the door 62. In various embodiments, the thickness of front frame and rear frames 15, 20 (FIGS. 1-2) can be such that artist's canvas/panel will not come in contact with the door knob 63 when the easel 5 is in the retracted condition (as seen in FIG. 1). That is, the combined thickness of front and rear frames "B" (Seen in FIG. 3B) can be greater than the length of the door knob 63. However, generally speaking for the easels described in this disclosure, the entire easel should not be more than 1 foot thick ("B"), as to avoid preventing door 62 from being fully opened. In most embodiments, the easel will be less than 6 inches in thickness.

FIGS. 3A-B also show an optional stabilizing strap assembly 60 that will help hold the easel 5 stationary if the user deems it necessary. This stabilizing strap assembly 60 can be a short piece of flexible nylon (or other material) strap 65 that is attached to the easel and another piece of flexible nylon strap 70 affixed to a lower door bracket 75 that is configured to fit securely under the lower edge of the door 62. The nylon straps 65 and 70 can be joined and separated by a standard release snap 80. By pulling on the loose end of the nylon strap 70, the stabilizing strap assembly 60 is tightened and pulls down on the entire easel 5. This will tend to make rear frame 10 come in contact with the face of the door 62 and will keep it from moving. The stabilizing strap assembly 60 can be loosened by pinching the sides of the release snap 80, thus allowing the easel 5 to be adjusted from side to side or removed from the door 5.

Figure 4:
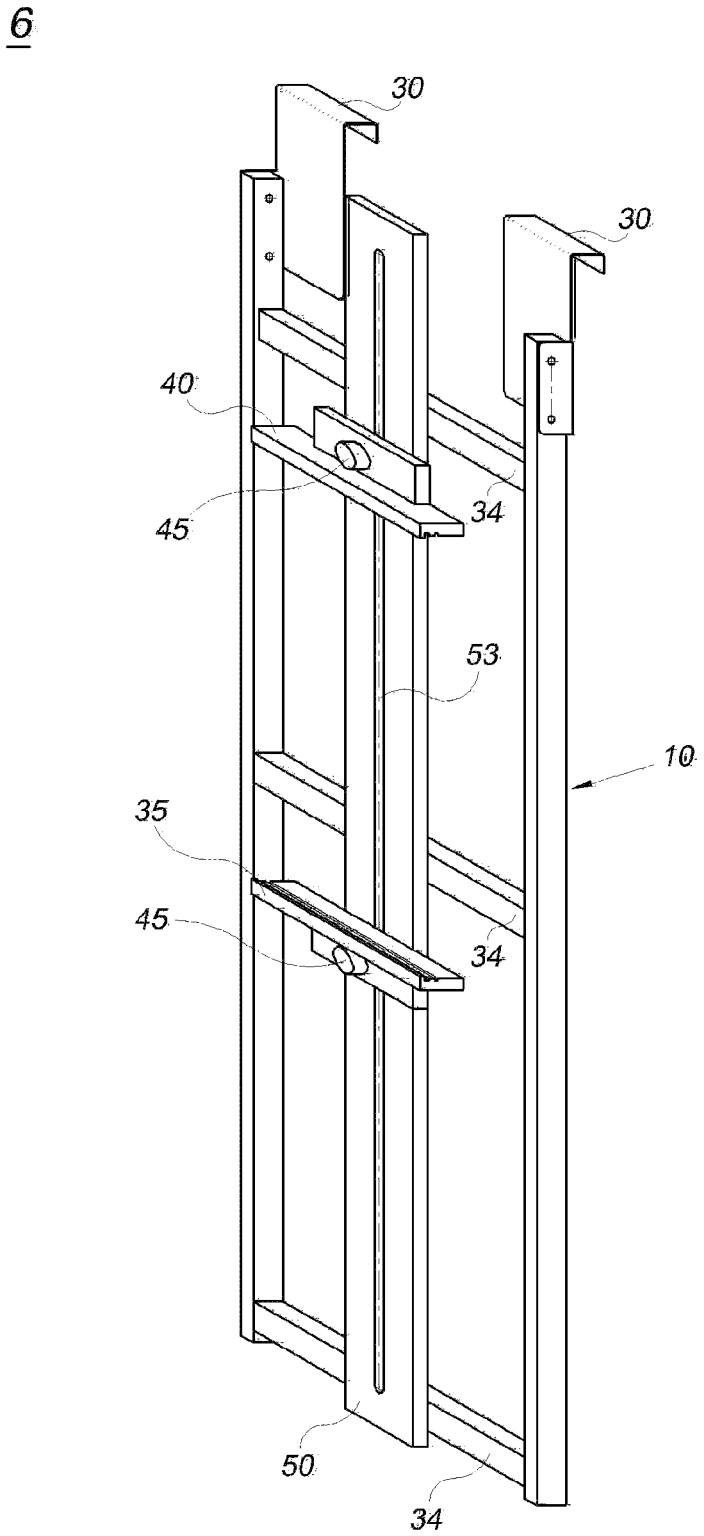
FIG. 4 is an illustration of another embodiment of a door-mountable easel.

FIG. 4 is an illustration of another door-hung height adjustable easel 6 without a front frame. The vertical fixture base 50 is mounted to supporting member(s) of rear frame 10 rather to an extendable front frame 15, as described in FIGS. 1-2. Therefore, an attached canvas/panel will be constrained to a vertical, front-facing positioning. Adjustable height bottom artwork fixture 35 and top artwork fixture 40 are also shown with slotted hole 53 in vertical fixture base 50, as well as tightening knob(s) 45 connected to rear locking bolts/pins. Aspects of the operation of this embodiment are similar to those described above, with the exception that a front frame is missing and therefore are understood to be self-explanatory.

The entire easel 6 is hung from a door with bracket(s) 30. The bracket(s) 30, are coupled to the rear frame 10, and configured in a manner to allow placement over the top edge of a door. The width and weight of the rear frame 10 gives some stability to the overall assembly, however an optional stabilizing strap assembly 60 (as shown in FIG. 3) may still be necessary depending on the user's needs and preferences. Some artists may prefer the easel assembly in this vertical configuration. It is a much simpler and less expensive device than the easel 5 described in FIGS. 1-2. If vertical fixture base 50 (and attendant travel mechanisms) is designed to be of sufficient height, the artist's canvas or panel can be raised or lowered to be used in a standing or seated position.

Figure 5:
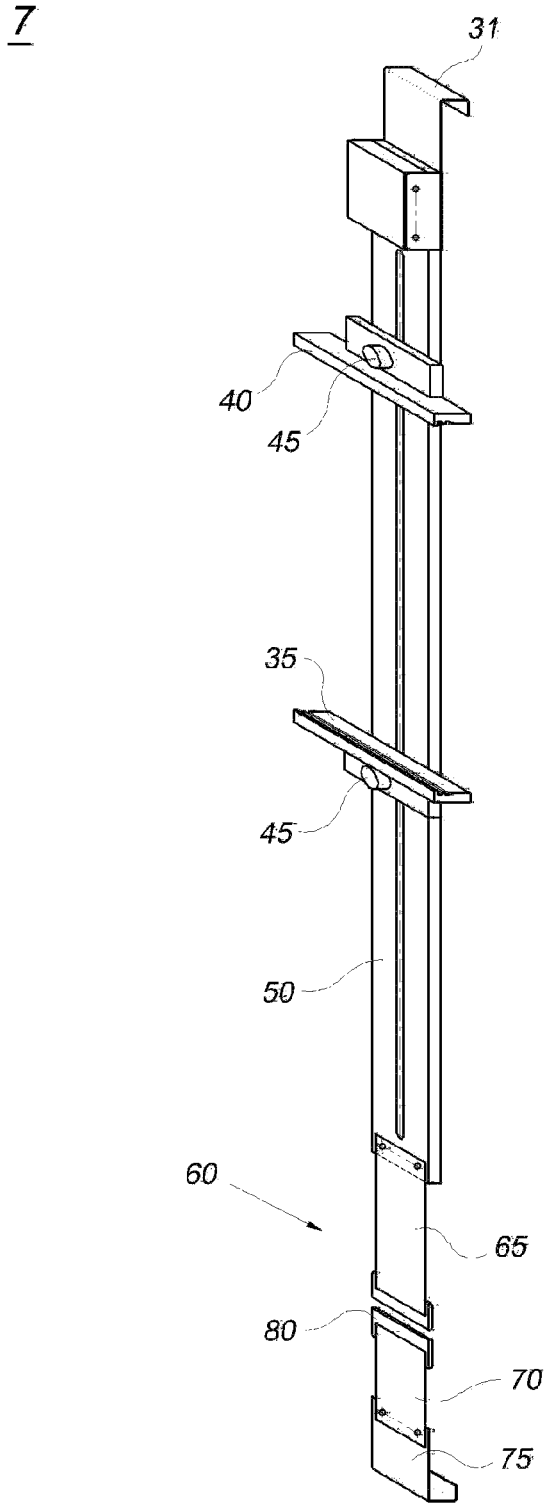
FIG. 5 is an illustration of another embodiment of a door-mountable easel.

FIG. 5 is another door-hung adjustable easel 7 without front or back frames. Easel 7 is a simplification of the earlier-described easels 5, 6. Like FIG. 4's easel 6, an artist's canvas or panel that is attached to this easel 7 will be constrained to a vertical, front-facing positioning. Top-mounted hanging bracket 31 is attached to vertical fixture base 50, having adjustable height bottom artwork fixture 35 and top artwork fixture 40, slotted hole 53, as well as tightening knob(s) 45 connected to rear locking bolts/pins. However, rather than vertical fixture base 50 being attached to any supporting member(s), the top of vertical fixture base 50 is attached to bracket 31. The bottom of vertical fixture base 50 is attached to stabilizing strap assembly 60, to add stability to this configuration. If the vertical fixture base 50 (and attendant travel mechanisms) is designed to be of sufficient height, the artist's canvas or panel can be raised or lowered to be used in a standing or seated position. Aspects of the operation of this embodiment are similar to those described above, with the exception that a front frame is missing and therefore are understood to be self-explanatory.

The reduction of materials for this configuration and the compactness offers potential cost benefits, as compared to the easels described above. FIGS. 4-5 are provided to demonstrate that multiple schemes, methods, designs can be used to modify the designs shown in FIGS. 1-2 to arrive at a door-hangable easel. Therefore, it is understood that one of ordinary skill in the art may modify or change aspects of the easels 4, 5, 6 without departing from the spirit and scope of this disclosure. For example, FIG. 5's bracket 31 may be attached to the top of vertical fixture base 50 via a strap (similar to stabilizing strap assembly 60), or multiple straps may extend from ends of vertical fixture base 50 (similar to pants suspenders).

Figure 6:
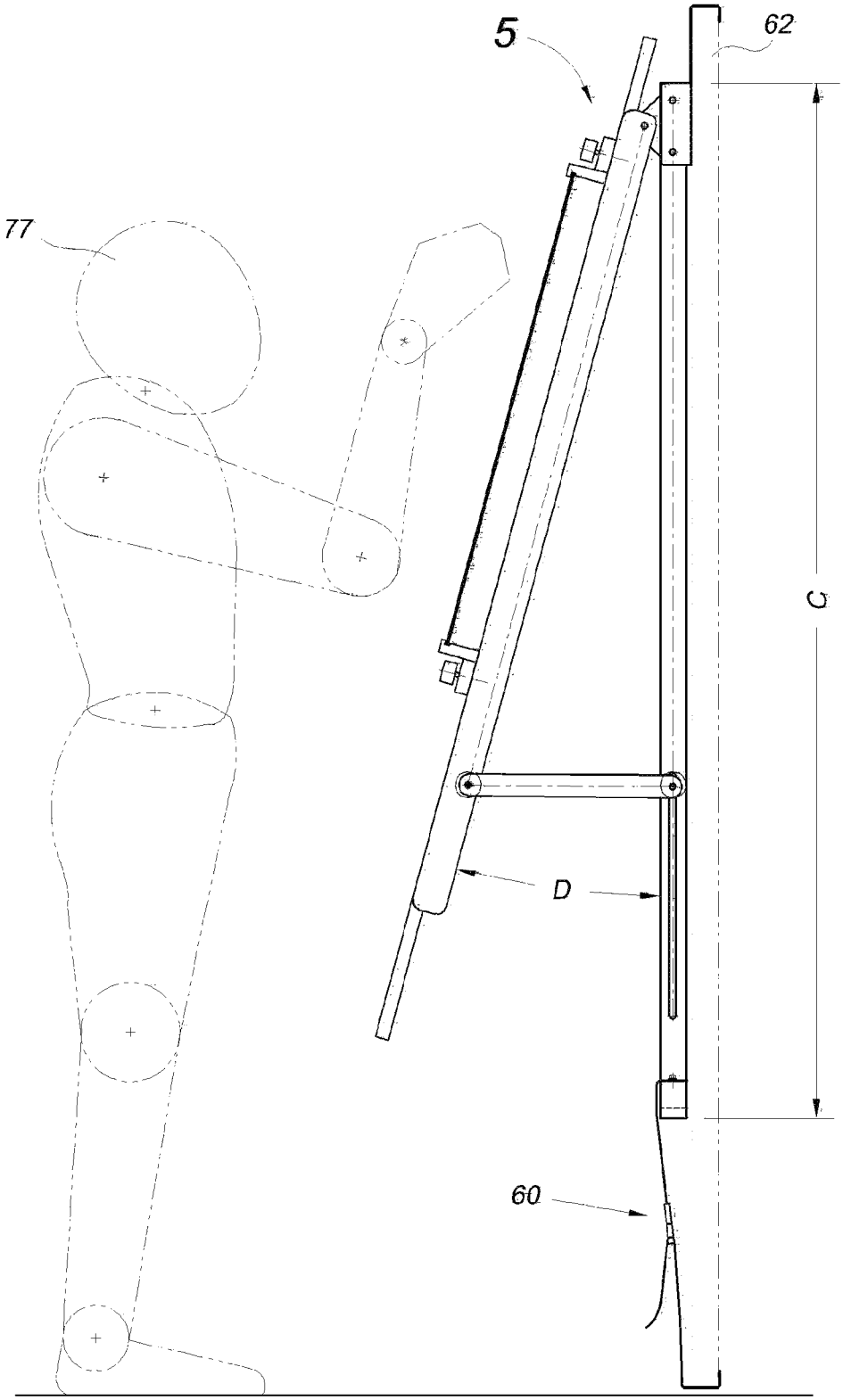
FIG. 6 is an illustration of the easel of FIG. 2 mounted to a door and being used in a standing position.

FIG. 6 is an illustration showing an easel of the form shown in FIG. 2 being used by a user 77 in a standing position, where "D" represents the maximum open/extended angle and "C" the height of the easel. "D" and "C" are design parameters that can be adjusted or tailored during manufacturing. As a point of reference, however, for a standard door height of 80 inches, one possible commercial embodiment can have a "C" of 60 inches and "D" of 15 degrees.

Figure 7:
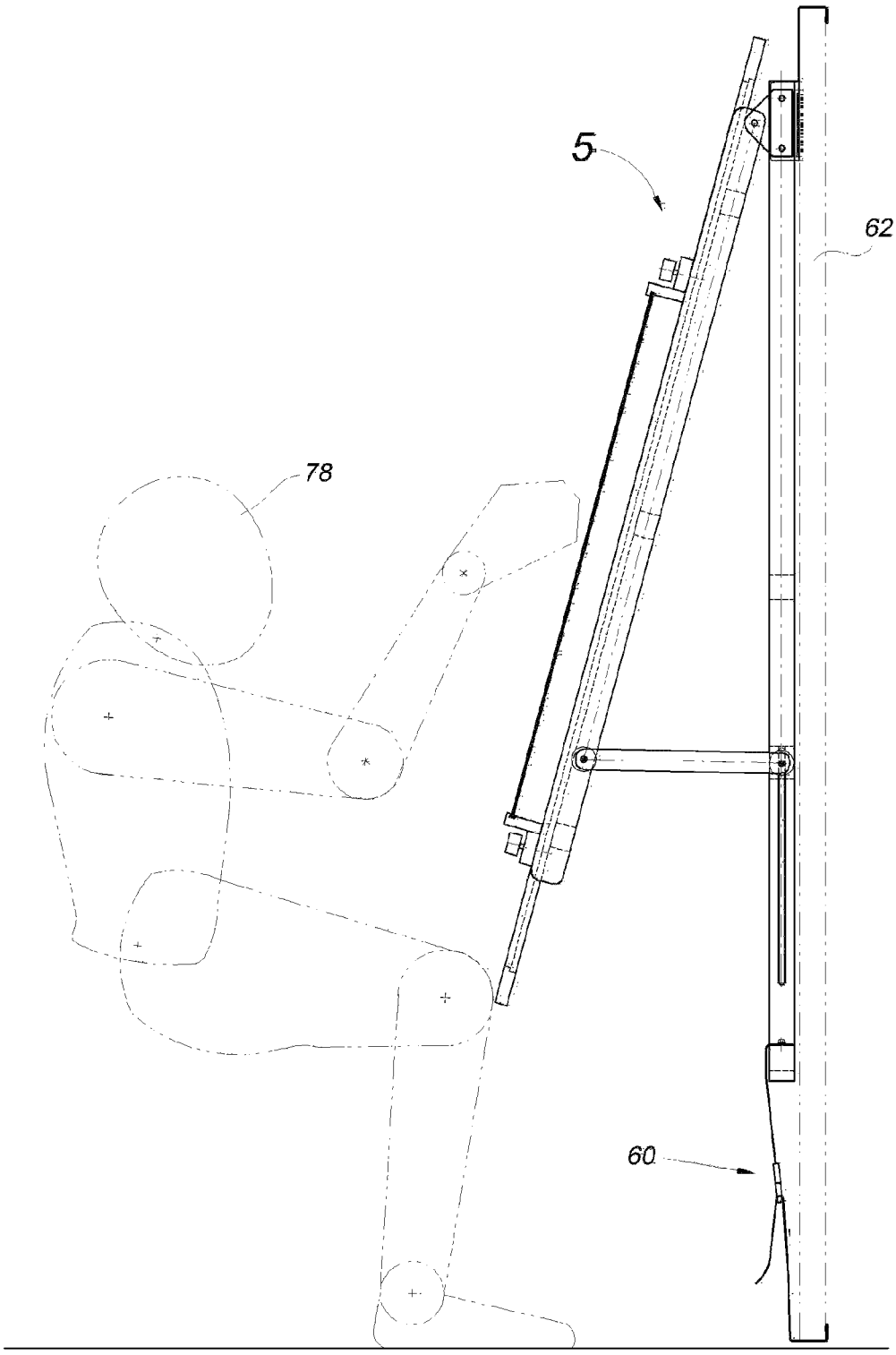
FIG. 7 is an illustration of the embodiment of FIG. 2 mounted to a door and being used in a sitting position.

FIG. 7 is an illustration showing a user 78 in a standing position. It is noted that user 78 can decide to stand or sit based on his "height" adjustment preference or preferred working position. Aspects of this FIG. are understood to be self-explanatory.

Figure 8A:
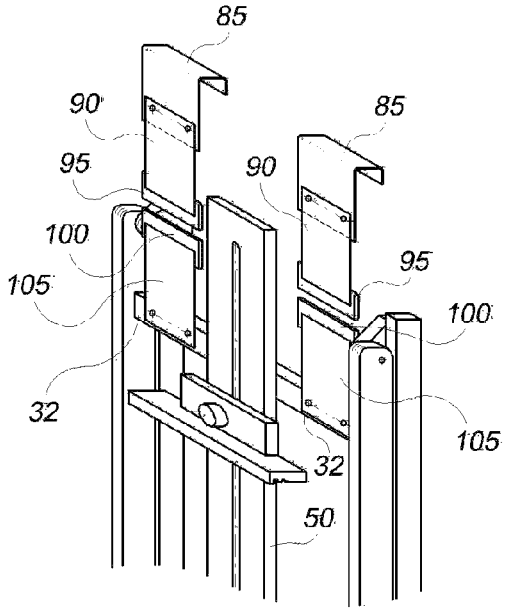
FIG. 8A is an illustration of a top portion of an embodiment of a door-mountable easel showing an alternate mounting arrangement.

FIGS. 8A-8D are illustrations of various top section mounting arrangements applicable to the respective embodiments of this disclosure. Specifically, FIG. 8A is an illustration of an alternate top section mounting arrangement analogous in many ways to the adjustable bottom stabilizing strap assemblies 60 shown in FIGS. 3A-B and 5, but configured for a top mount. Of course, these embodiments can also be representative of a bottom mounting arrangement, if attached to the bottom of an easel. A plurality of brackets 85 are attached to a top strap 90 (may be of flexible nylon or other similar performing material) that is connected to bottom strap 105 via respective top and bottom release connectors 95, 100, respectively. The bottom strap 105 is shown as attached to the front frame's supporting member 32. The straps may be adjusted in tension to "lock" the top portion of the easel to the door.

Figure 8B:
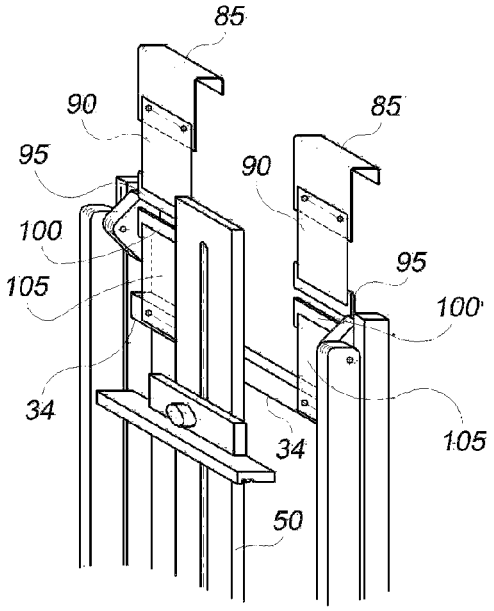
FIG. 8B is an illustration of a top portion of another embodiment of a door-mountable easel showing an alternate mounting arrangement.

FIG. 8B is an illustration of an alternate top section mounting arrangement, similar to FIG. 8A, however, the bottom strap 105 is attached to the rear frame's supporting member 34 rather than to the front frame's supporting member 32. This configuration is simply a translation of the attachment location of FIG. 8A's straps to the rear frame's supporting member 34, all other elements being analogous and self-explanatory.

Figure 8C:
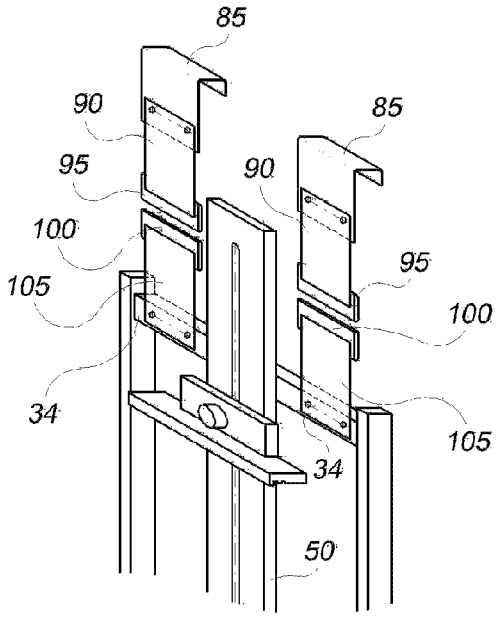
FIG. 8C is an illustration of a top portion of another embodiment of a door-mountable easel showing an alternate mounting arrangement.

FIG. 8C is an illustration of an alternate top section mounting arrangement applied to the embodiment of FIG. 4. This embodiment contemplates a top-frameless attachment scenario, wherein the elements 85, 90, 95, 100, 105 are analogous to the previous FIGS. 8A-B, however, the bottom strap 105 is attached to the rear frame's supporting member 34.

Figure 8D:
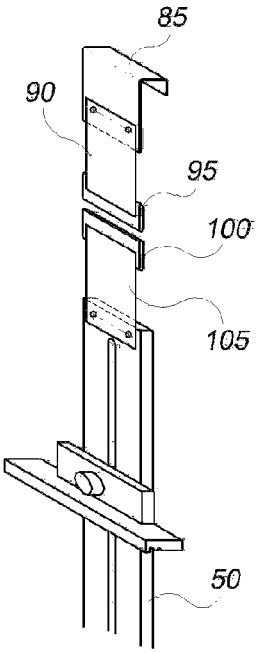
FIG. 8D is an illustration of a top portion of another embodiment of a door-mountable easel showing an alternate mounting arrangement.

FIG. 8D is an illustration of an alternate top section mounting arrangement applied to the vertical fixture base 50 of FIG. 5. This embodiment contemplates a frameless attachment scenario, wherein a single strap configuration is utilized. Elements 85, 90, 95, 100, 105 are analogous to the previous FIGS. 8A-C, however, the bottom strap 105 is attached to the vertical fixture base 50.

While the straps and releasable connectors attached to the straps are illustrated as being separate from the top mounting (or bottom mounting) brackets, it is expressly understood that in some embodiments, it may be of a preference to have the releasable connector directly attached to the bracket. That is, the strap may release or be tensioned via a direct coupling to the bracket rather than through an intermediary strap-to-connector-to-strap arrangement. Conversely, the releasable connector (and/or tensioning mechanism) can be directly attached to the supporting member. Thus, various modifications are within the purview of one of ordinary skill in the art.

Similarly, while the FIGS. illustrate a releasable strap (with connector) configuration, it is understood that other mechanisms for releasing and/or tensioning may be utilized without departing from the spirit and scope of this disclosure. For example, a belt-like tensioning/connector may be utilized. Therefore, the connector arrangements shown above are simply illustrative and understood not to be limiting, as there are numerous other mechanical devices well known to one of ordinary skill in the art that may be substituted to provide a similar tensioning and/or connector-like effect.

Further, while the embodiments of FIGS. 8A-C illustrate two brackets with accompanying straps, a single bracket may be utilized, for example, as seen in FIG. 8D, as well as more brackets.

Figure 9:
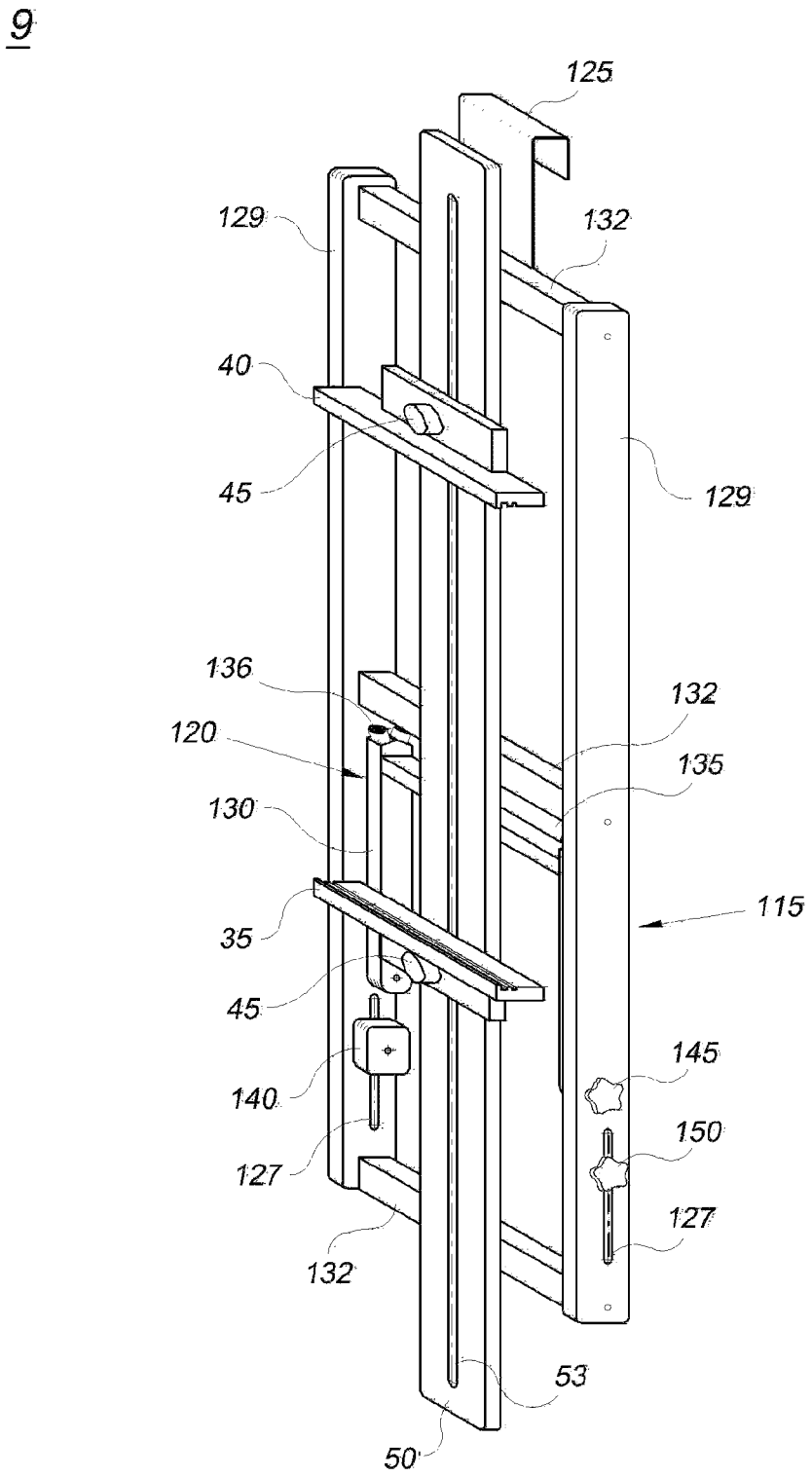
FIG. 9 is an illustration of a perspective view of another embodiment of a door-mountable easel in a "closed" state.

FIG. 9 is an illustration of a perspective view of another mountable easel 9 in a "closed" state. This embodiment 9 contemplates a single frame 115 that is attached to a door/wall (not shown) via movable arms 120 that extend from the back frame 115 against the door/wall. This embodiment can be considered, in some ways, as a hybridization of the previously described embodiments. Easel 9 is shown without a stabilizing strap assembly, as this design is contemplated be manufactured with materials that are of sufficient weight to remain stabilized. However, in some instances, the addition of a stabilizing strap assembly (as shown in the previous embodiments) may be implemented, according to design preference.

Mounting bracket 125 is attached to supporting member 132, one or more which bridge vertical members 129. Vertical fixture base 50 is attached to supporting members 132, having slot 53 wherein bottom and top artwork fixtures 35, 40 (and tightening knob 45) ride upon, the functions of which were described above. Displacement of frame 115 and associated fixture base 50 is accomplished via pivoting of movable arm 120 from frame 115 and adjustment of angle support 140. Movable arm 120 can be an assembly, multiple arms, or a single "L", etc. that functions to "push" the easel 9 away from the resting surface. Accordingly, any structure that allows for the easel 9 to be pushed away can be used, without departing from the spirit and scope of this disclosure.

Movable arm 120 is held in position via pressure exerted by tightening knob 145, which can be loosened to allow movable arm 120 to be pivoted/rotated away from frame 115. Similarly, angle support 140 is held in position via pressure from tightening knob 150, which can be loosened to allow angle support 140 to rotate and/or move within slot 127. Cushioning elements 136 are affixed or attached to an end of pivoting member 130 that forms the vertical portion of movable arm 120. The cushioning elements 136 can be optional and are understood to help protect the wall/door.

Figure 10:
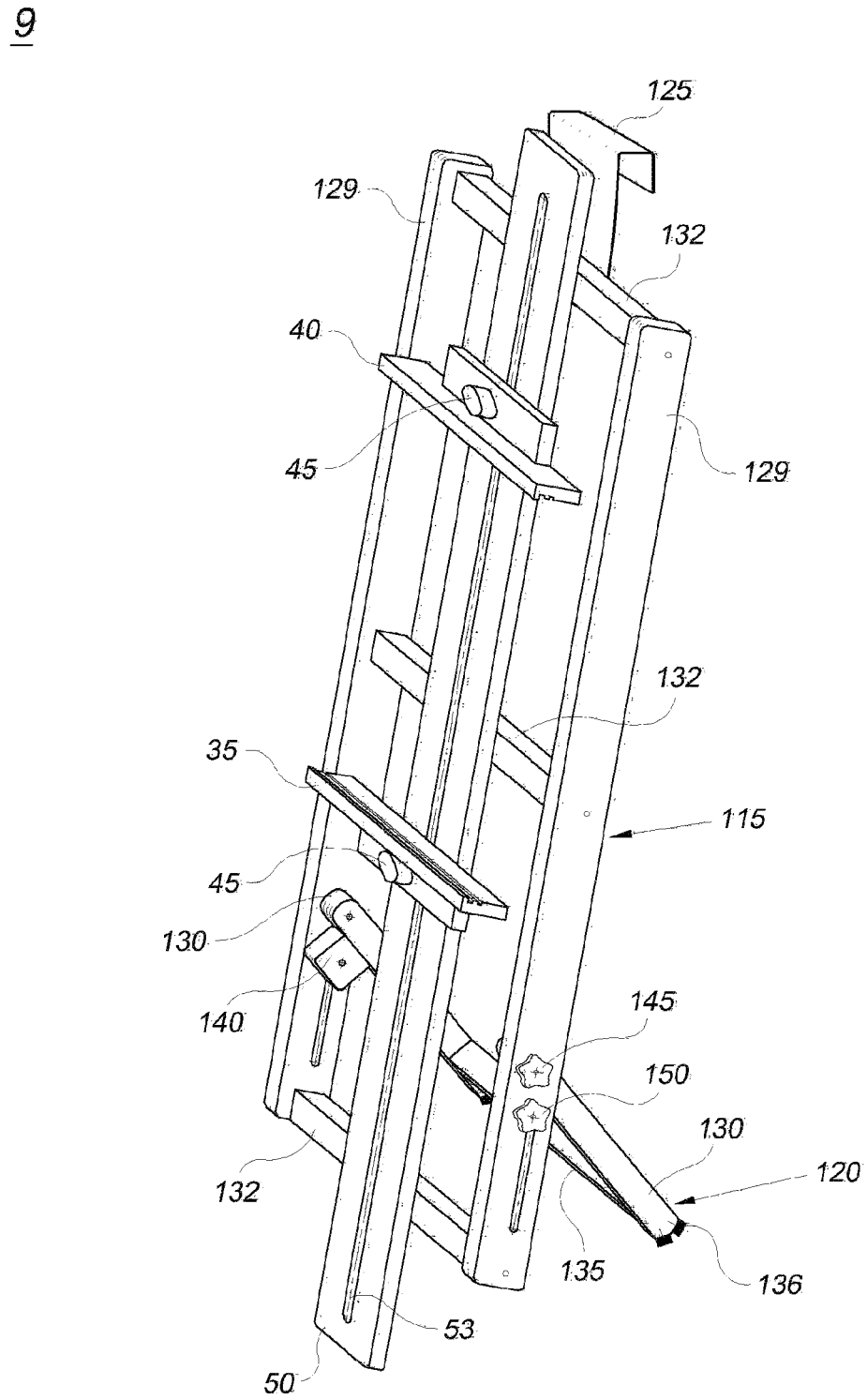
FIG. 10 is an illustration of a perspective view of the embodiment of FIG. 9 in an "open" state.

FIG. 10 is an illustration of a perspective view of the embodiment of FIG. 9 in an "open" state. Movable arm 120 is shown angled "back" (or rotated) to push against a wall or door (not shown), so as to prop the easel away from the wall/door. In this open position, a flat side of angle support 140 is positioned to be held against the pivoted (e.g., rotated) pivoting member 130 to prevent movable arm 120 from rotating or pivoting from its "fixed" position. Tightening of knob 150 assists in securing angle support 140 with its orientation to pivoting member 130. In some embodiments, mounting bracket 125 is flexible, allowing for the rotation of the easel assembly 9 to a desired working position, while still being rigid enough to keep the easel 9 stable for use. This enables easel 9 to be displaced from the door/wall while not requiring a pivoting back frame as seen in other previous embodiments. Of course, the elimination of these additional structures results in a lighter easel 9.

Figure 11A:
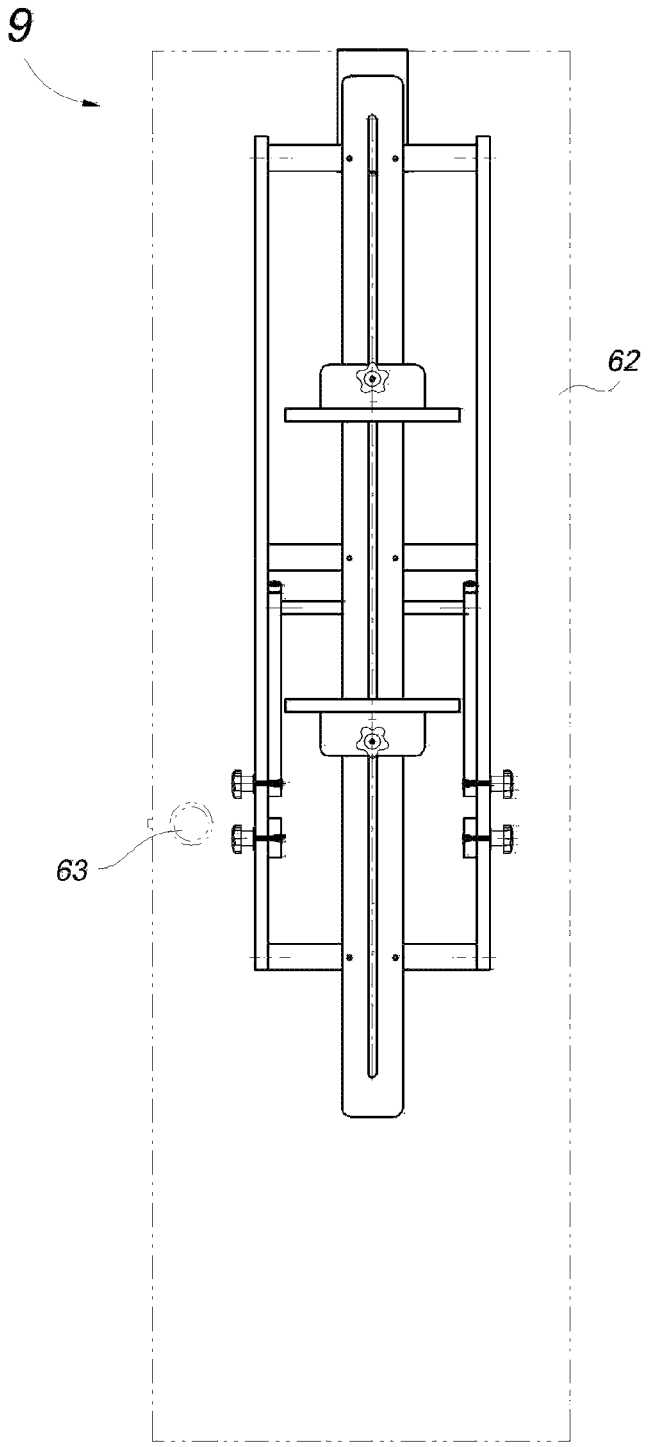
FIG. 11A is an illustration of a front view of the embodiment of FIG. 9.

FIG. 11A is an illustration of a front view of the easel 9 of FIG. 9 (closed state), attached to the top of door 62 having a door knob 63. It is evident, in order to avoid obscuring the door knob 63, this particular embodiment is designed to be narrower than the door 63.

Figure 11B:
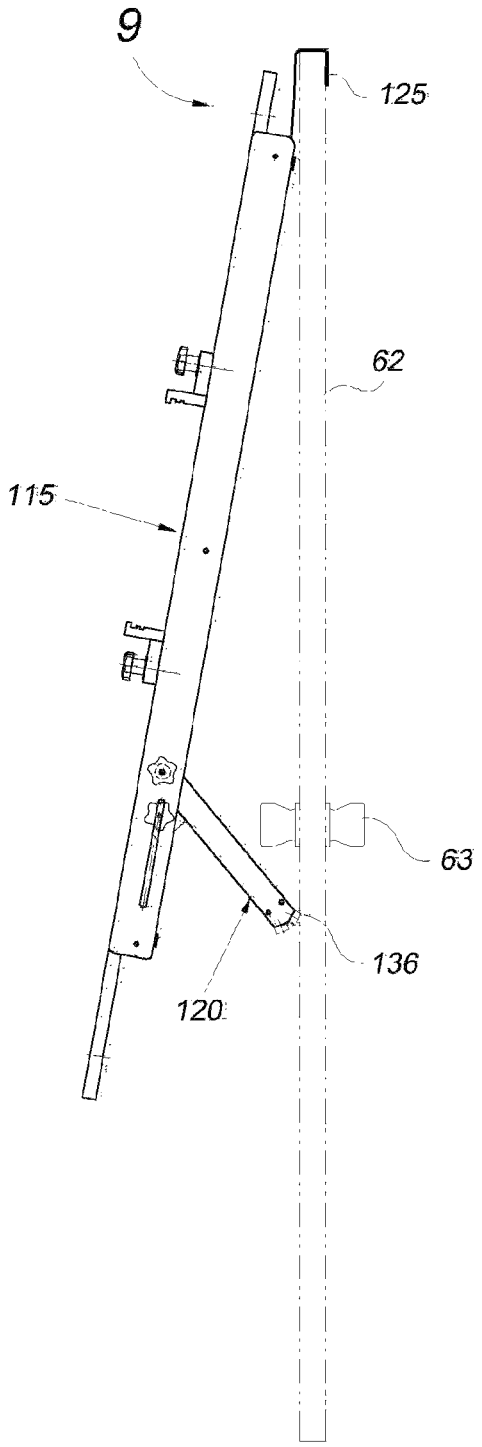
FIG. 11B is an illustration of a side view of the embodiment of FIG. 9.

FIG. 11B is an illustration of a side view the embodiment of FIG. 10 (open state), attached via bracket 125 to the top of door 62 having a door knob 63. The angling of the easel 9 via the pivoting of movable arm 120, having cushioning elements 136, against door 62 is clearly seen here. Specifically, bottom of frame 115 is pivoted away from the door 62 due to the displacement caused by movable arm 120.

Figure 12:
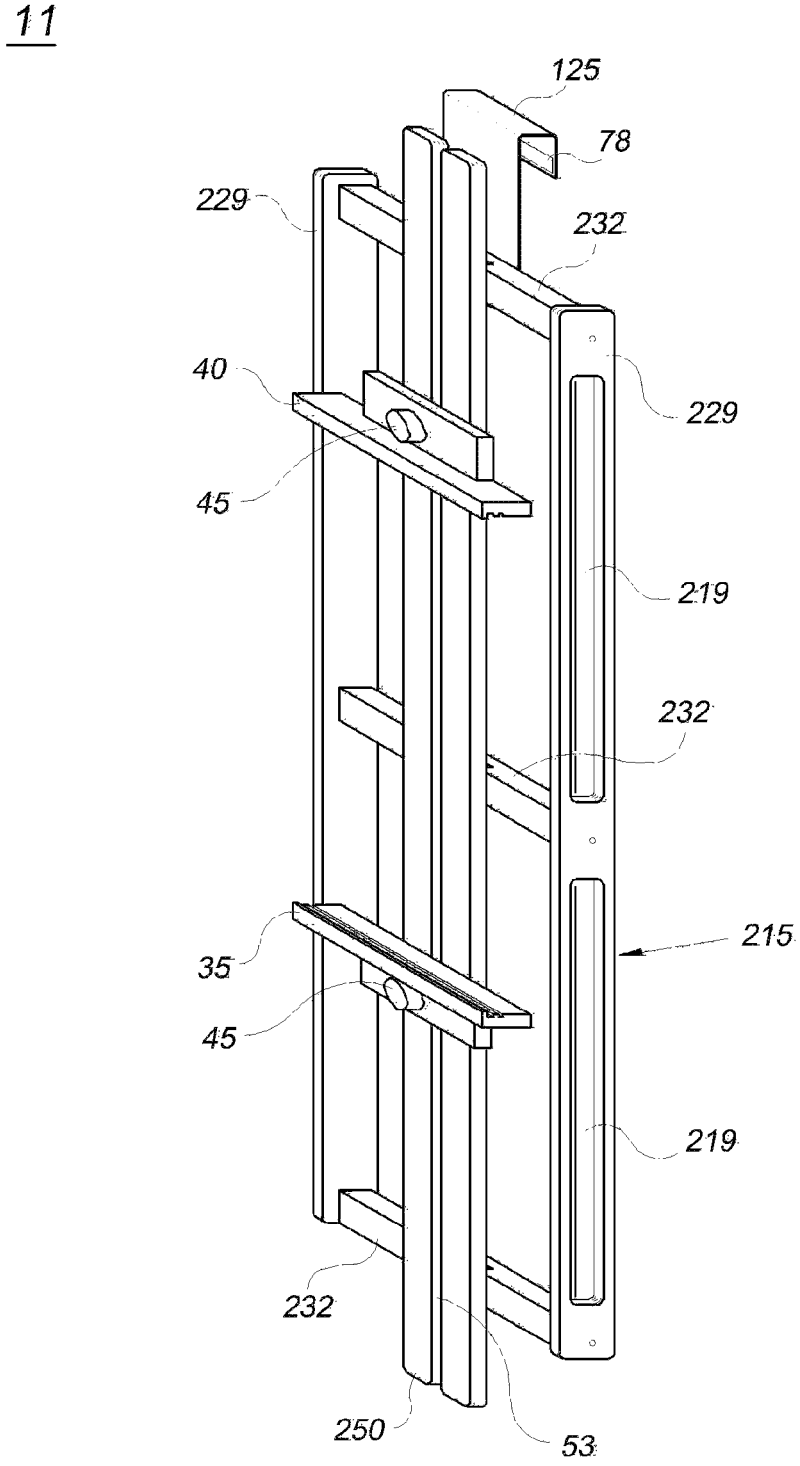
FIG. 12 is an illustration of a perspective view of another embodiment of a door-mountable easel.

FIG. 12 is an illustration of a perspective view of another embodiment of a door-mountable easel 11 with a non-pivoting frame 215. This embodiment is similar to the embodiment of FIG. 4. However, bracket 125 is attached to supporting member 232 which joins vertical member 229 of frame 215. Bracket 125 is also shown here with an optional door cushion 78 to prevent scratching of the door (not shown). Frame 215 contains cutouts 219 to help lighten the overall easel 11. Cutouts 219 may be entirely through frame 215 or partially through, depending on implementation preference. Vertical fixture base 250 is attached to frame 215 and contains groove/slot 53 for operation of bottom and top artwork fixtures 35, 40 (and tightening knob 45). In some embodiments, bracket 125 may be angled and also frame 215 may have portions of vertical members 229 angled away from the door, to provide a pre-configured separation from the door.

Figure 13A:
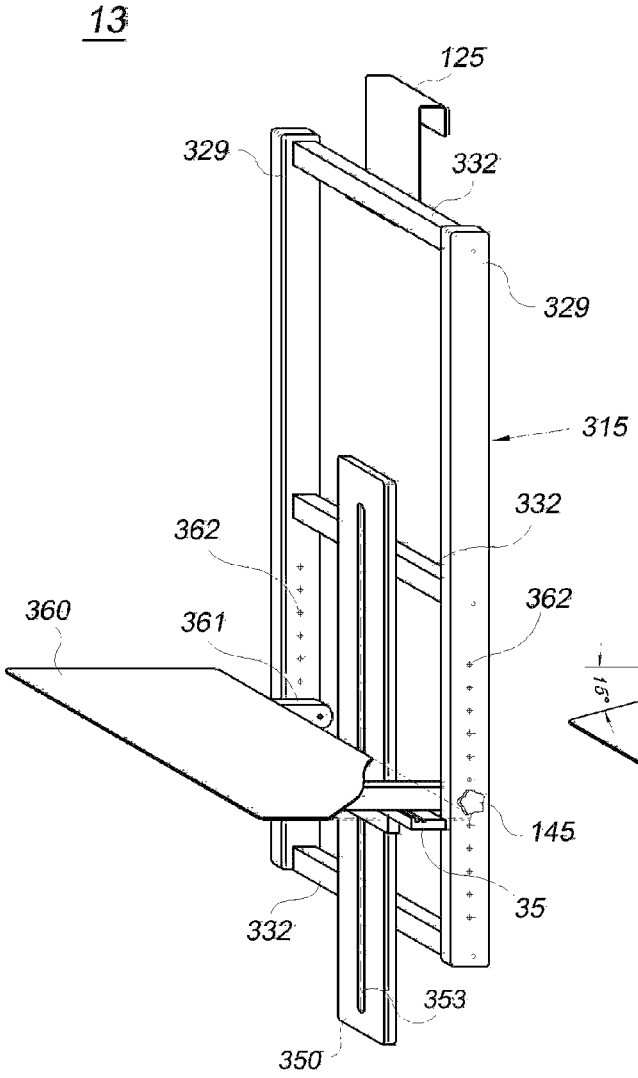
FIG. 13A is an illustration of a perspective view of another embodiment of a door-mountable easel with a tray.

FIG. 13A is an illustration of a perspective view of another embodiment of a door-mountable easel 13, wherein bracket 125 is attached to supporting member 332 which joins vertical member 329, to form frame 315. However, this embodiment has a surface or tray 360 that is attached/attachable to movable arm 361 which pivots "outward" to support the tray 360. Movable arm 361 may be integrally attached to tray 360. Vertical fixture base 350 contains slot/groove 353 wherein bottom (or top) fixture 35 ride upon, but in this embodiment is shown to support movable arm 361, thus preventing movable arm 361 from lowering beyond the position set by bottom (or top) fixture 35. Movable arm 361 can be tightened via tightening knob 145 which can be removed and the movable arm moved to different heights in accordance with holes 362 disposed along vertical member 329. In some embodiments, holes 362 may be replaced by a slot or groove or other equivalent functioning element.

Figure 13B:
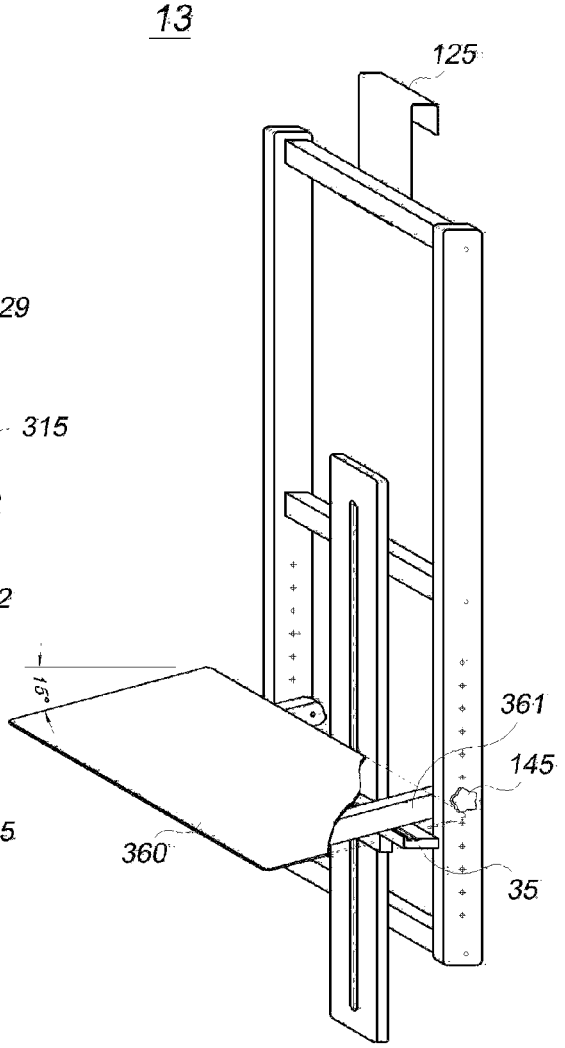
FIG. 13B is an illustration of the embodiment of FIG. 13A, but with a lowered tray.

FIG. 13B is an illustration of the embodiment of FIG. 13A, but with the tray 360 lowered (shown here as angled by 15 deg.). Displacement/angling of the tray 360 can be easily accomplished by loosening the respective tightening knob 145 and moving/rotating movable arm 361 to a desired position/angle and moving bottom (or top) fixture 35 against the positioned movable arm 361, and tightening the respective tightening knob 145 and 45 (not shown).

The above embodiments illustrate a "shortened" vertical fixture base 350, so as to allow a person to work with the bottom half of the easel 13, for example, for people who are sitting or are wheelchair bound, not needing the upper working portion of the easel 13. Tray 360 may be designed to have movable arms 361 attached to the tray 360 and then mounted to holes 362 at a desired height. Artwork can be placed on tray 360 or tray 360 can be used as a working surface/table, depending on desired action.

Figure 14A:
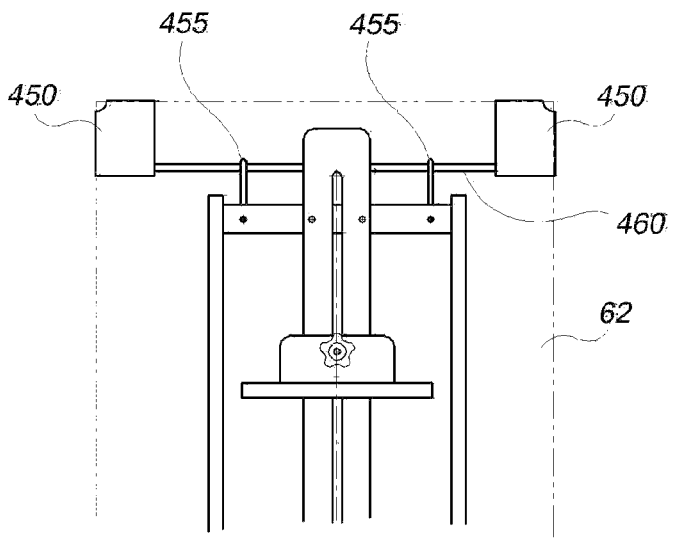
FIG. 14A is frontal top section view of another embodiment of a door-mountable easel mounted to corners of the door.

FIG. 14A is frontal top section view of another embodiment of a door-mountable easel, wherein the mechanism for attachment is via a separate hanging/attachment fixture 450, that is attached to the top corners of the door 62. The fixture 450 provides a bar 460 that allows secondary hanging means 455 to be attached thereto. For example, secondary hanging means 455 may be one or more hooks that hook over bar 460. This enables the easel to be supported adequately by the fixture 450 and also rotated out and adjusted independently of the door 62. Of course, other ways to attach or mount an easel to the door 62 via a primary and secondary attachment mechanisms may be used, without departing from the spirit and scope of this disclosure. For example, fixture 450 may be a canvas or fabric material that hangs over the corners of the door 62.

Figure 14B:
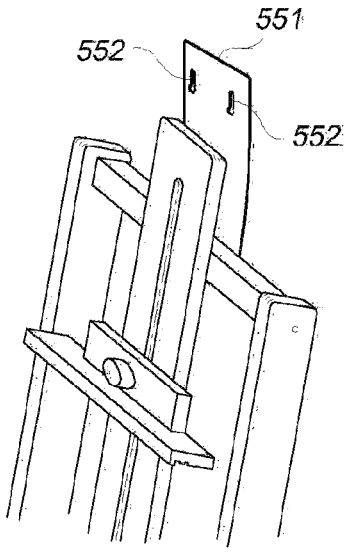
FIG. 14B is perspective top section view of another embodiment of a mountable easel with a "flat" bracket.

FIG. 14B is perspective top section view of another embodiment of a mountable easel, wherein the mechanism for attachment is via bracket 551 which has nail or screw holes 552. This contemplates hanging against a wall or surface that can be nailed/screwed into, etc.

Figure 14C:
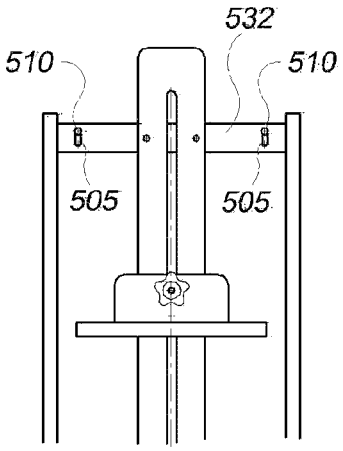
FIG. 14C is a frontal top section view of another embodiment of a mountable easel without a bracket.

FIG. 14C is a frontal top section view of another embodiment of a mountable easel, wherein the mechanism for attachment is via nail or screw holes 505 which are positioned in supporting member rather than via a bracket. Nails 510 are shown in holes 505, which secure the easel.

Figure 15:
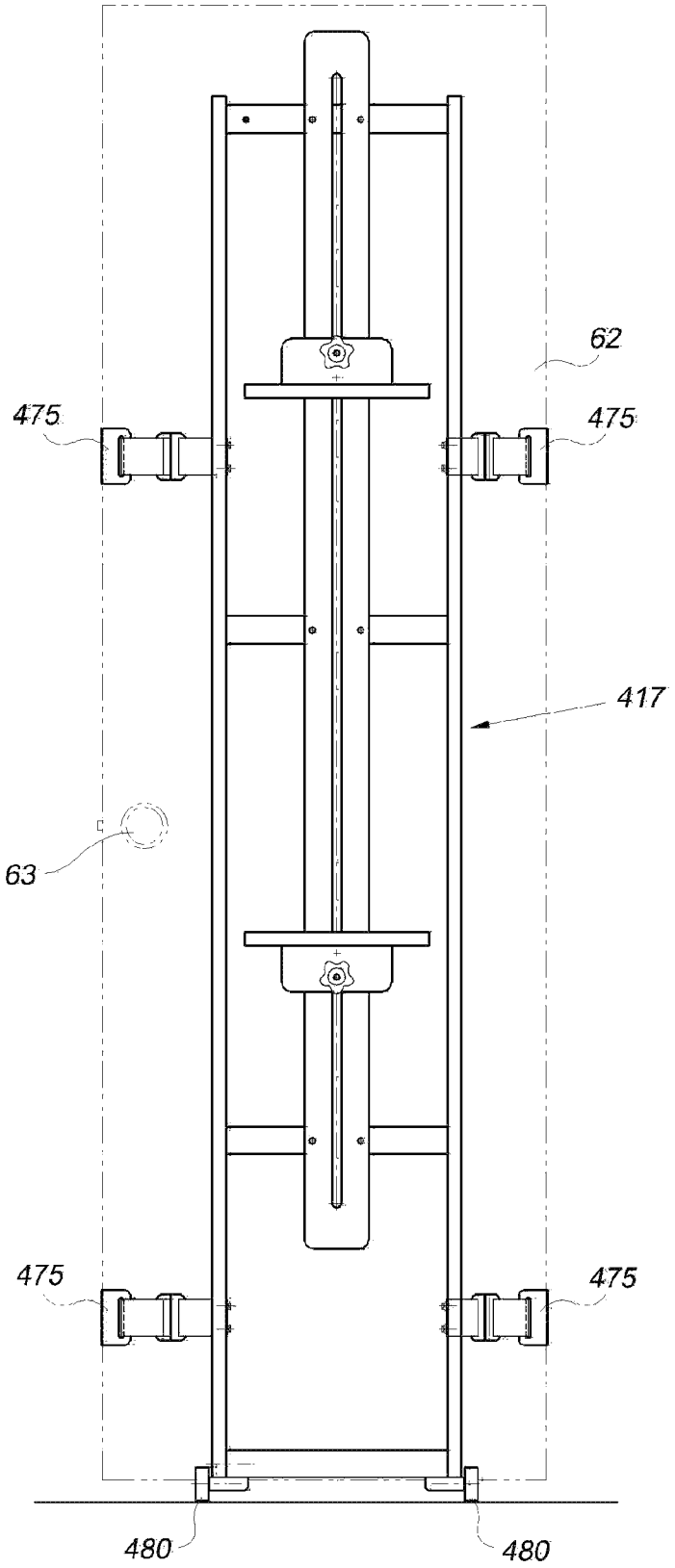
FIG. 15 is a front view of another embodiment of a mountable easel with a different mounting mechanism.

FIG. 15 is a front view of another embodiment of a mountable easel, wherein the mechanism for mounting is via tensioned brackets 475 attached to sides 417 of the easel and tensioned/attached about the ends of a door 62 shown here with knob 63. Vertical support of the easel is maintained by one or more wheel assemblies 480 attached to a bottom portion of the easel. The wheel assemblies 480 support the weight of the easel whether the door 62 is stationary or moving. The tensioning may be accomplished with flexible straps, which allow the easel to travel up and down vertically to account for any uneven floor surfaces. This arrangement would allow for a much heavier easel and accessories due to much less loading on door supports (e.g., hinges).

Figure 16:
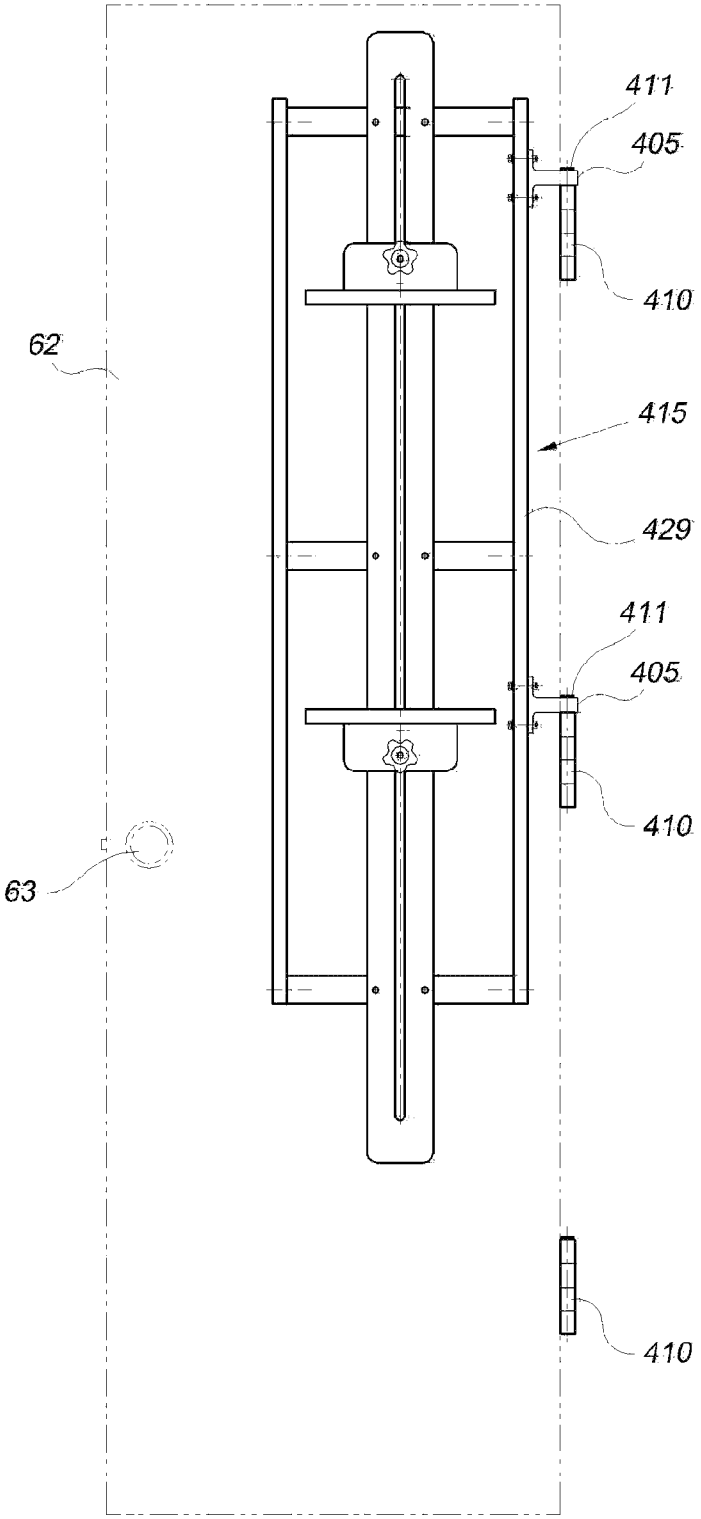
FIG. 16 is a front view of another embodiment of a mountable easel mounted to door hinges.

FIG. 16 is a front view of another embodiment of a mountable easel, wherein the mechanism for mounting to a door 62 is via attachment to the door hinges 410. Hinge mount 405 is attached to vertical member 429 of the easel frame 415, and is attached to the door hinges 410 via hinge pin 411 which is placed through hinge mount 405 and hinges 410. This allows the easel to be rotated out from the wall using the hinge mount 405.

Figure 17:
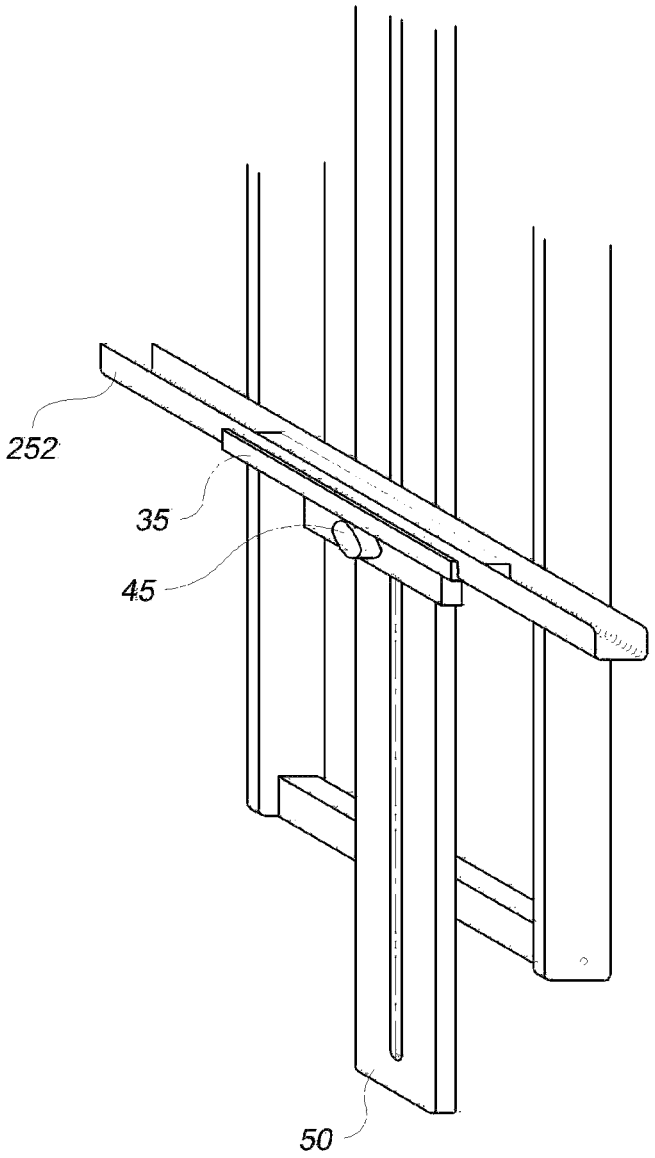
FIG. 17 is a perspective view of an easel with a removable tray.

FIG. 17 is a perspective view of an easel with a removable tray 252 that is attached to bottom artwork fixture 35, with knob 45. This FIG. shows the addition of a removable tray 252, which can be used for catching pastel/graphite dust. It is known that pastel/graphite paintings produce a lot of dust which can be captured by the tray 252. A cut-out in the middle of the tray 252 can be configured to allow it to saddle the artworks' canvas mount so as to be easily removed for cleaning.

Figure 18A:
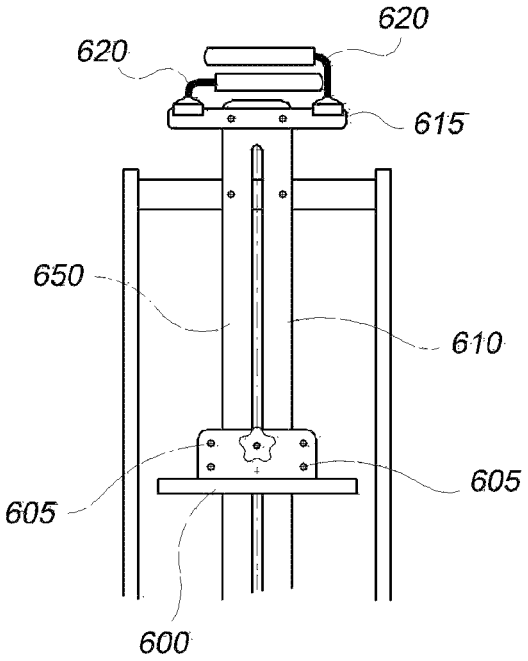
FIG. 18A is a top sectional view of an easel with top mounted lamp/accessories.
Figure 18B:
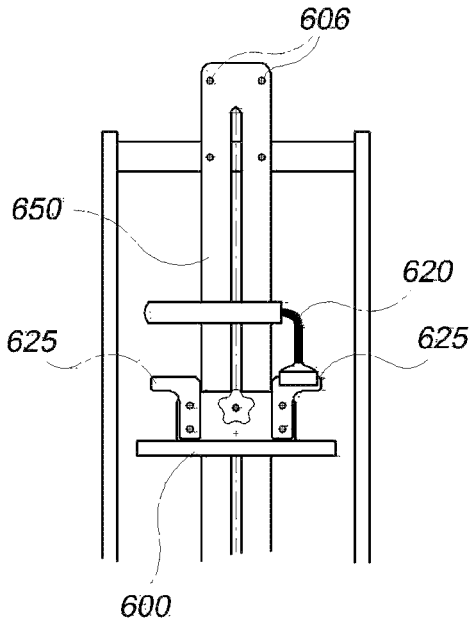
FIG. 18B shows a top sectional view of an easel with mounted lamp/accessories.

FIG. 18A is a top sectional view of an easel with lamp/accessories 620 that are attached to an accessory mounting bar or plate 615, etc. mounted to the top of vertical fixture base 650. Accessory mounting bar 615 can be rotated, moved, in some embodiments, depending on design preference. To accommodate accessories nearer to the top of a mounted artwork for increased lighting (if the accessory is a lamp), top artwork fixture 600 can have mounting holes 605 for either mounting accessory mounting bar 615 or for direct mounting of the accessory itself. For example, FIG. 18B shows a top sectional view of an easel with lamp/accessories 620 that are attached to an accessory mounting plate 625 mounted to top artwork fixture 600. Of course, accessory mounting bar 615 (or plate 625, or modified versions of these) can be mounted to other portions of the easel.

Figure 19:
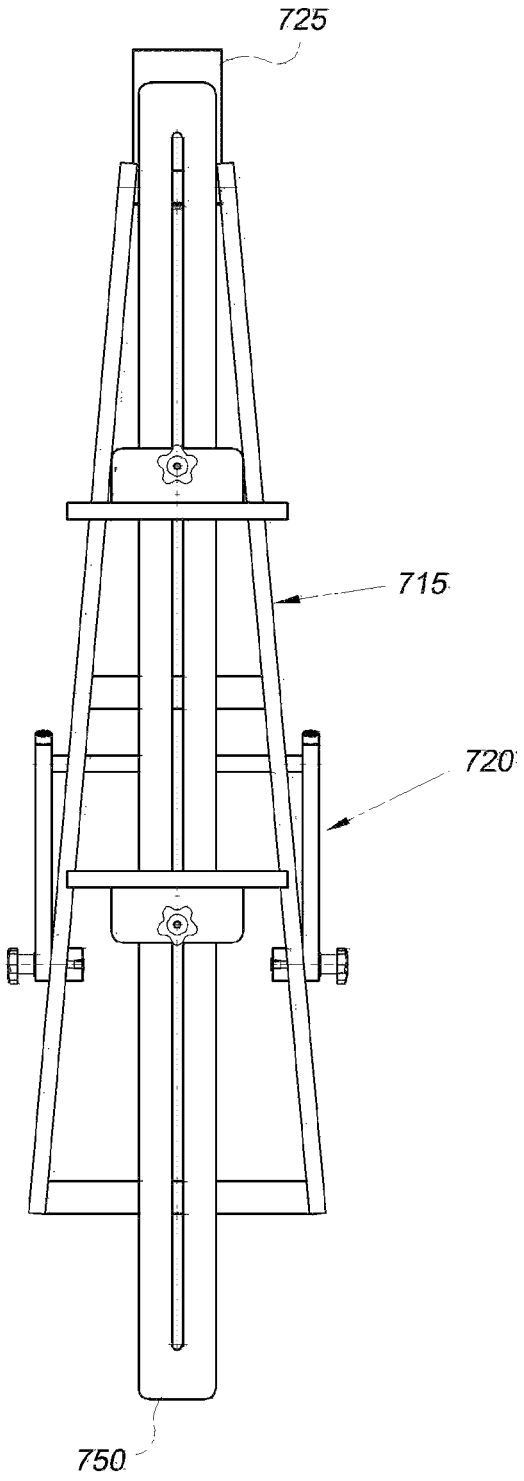
FIG. 19 is a front view of another embodiment of an mountable easel with an A-frame shape.

FIG. 19 is a front view of another embodiment of a mountable easel, wherein the frame 715 has an A-frame shape, or non-rectangular shape, or non-H-frame shape that is mounted via bracket 725. This FIG. illustrates movable arms 720 being part of the embodiment, but it is understood that this embodiment may not have the movable arms 720, or may have other features and elements as described in the above embodiments, without departing from the spirit and scope of this disclosure. It is believe that this embodiment may be lighter than the previous embodiments due to the use of less materials. It may also have more of an aesthetic appeal to some users.

Given the above embodiments, it is understood that fixtures and add-ons can be easily added to various embodiments of the easels. Non-limiting examples being lighting, a flat table surface, storage boxes, clipboard holder, electrical outlets, etc. The versatility and utility of the easel(s) will make it desirable by amateur and professional artists, as well as the parents of young users, who want a quality working area for their children that is easy to set-up, maintain and clean up, and that requires no additional free floor space.

The present disclosure is not to be limited in terms of the particular embodiments described in this application, which are intended as illustrations of various aspects. Many modifications and variations can be made without departing from its scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, implementations, and realizations, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those skilled in the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

It will be understood that many additional changes in the details, materials, steps and arrangement of parts, which have been herein described and illustrated to explain the nature of the invention, may be made by those skilled in the art within the principle and scope of the invention as expressed in the appended claims.

What is claimed is:

1. A hangable artist's easel, comprising:

at least one frame comprised of at least one substantially vertical support member and at least one substantially horizontal support member, the members being coupled to each other to form a substantially planar, upright supporting structure;

a longitudinal, workpiece supporting fixture, having an artist-side face, an opposite side face, a top portion and a bottom portion, and a single accommodation for vertical travel of a workpiece securing member, wherein the workpiece supporting fixture is vertically attached approximately to a vertical centerline of the at least one frame, wherein the accommodation is coincident with the vertical centerline of the frame;

at least one workpiece securing member, substantially horizontal in orientation having a horizontal face for securing a bottom or top horizontal side of a workpiece placed in the easel, releasably mounted to the artist-side face of the workpiece supporting fixture, being position-adjustable along the accommodation for vertical travel of the workpiece supporting fixture;

at least one releasable securing fixture, securing the at least one workpiece securing member to the workpiece supporting fixture; and a mounting mechanism coupled to the at least one frame, to allow the easel to be mounted to a door or wall.

2. The easel of claim 1, wherein the at least one frame are two frames, a top portion of a first frame being pivotally coupled to a top portion of a second frame, the first frame having the mounting mechanism and configured to rest against the door or wall.

3. The easel according to claim 1, wherein the accommodation for vertical travel is a slot through the workpiece supporting fixture and the releasable securing fixture is a threaded knob over a threaded bolt, the threaded bolt traveling through the slot.

4. The easel according to claim 1, wherein the mounting mechanism is a bracket that fits over a top, or corner or side of a door.

5. The easel according to claim 1, wherein the mounting mechanism comprises a hole in a top portion of the at least one frame or workpiece supporting fixture, or a plate attached to the at least one frame or workpiece supporting fixture, wherein a nail, screw or hook can be placed to attach the easel to a door or wall.

6. The easel according to claim 1, further comprising a tension adjustable strap attached to the mounting mechanism or to the at least one frame that is proximal to the door or wall.

7. The easel according to claim 1, wherein the mounting mechanism is attached to a hinge of a door.

8. The easel according to claim 1, further comprising at least one pivoting arm pivotally attached to a non-upper portion of the at least one substantially vertical support member, wherein the at least one pivoting arm, when extended from the vertical support member and secured from movement, operates to angle the at least one frame away from the door or wall.

9. The easel according to claim 8, further comprising a pivoting arm support, attached to the at least one substantially vertical support member that the at least one pivoting arm is attached to, and height adjustable along the at least one substantially vertical support member, the pivoting arm support having a flat side to contact and support the at least one pivoting arm.

10. The easel according to claim 8, further comprising a pivoting arm cushion disposed at an end of the pivoting arm, to cushion the end against the door or wall.

11. The easel according to claim 1, further comprising:

vertically spaced mounting holes or a vertical slot in the at least one substantially vertical support member; and a pivotable tray that is mountable to the holes or slot in the substantially vertical support member.

12. The easel according to claim 1, further comprising a removable dust tray, sized to fit between the workpiece securing member and the at least one workpiece supporting fixture.

13. The easel according to claim 1, further comprising an accessory attachment plate or bar, attached to the workpiece supporting fixture or to the at least one workpiece securing member.

14. The easel according to claim 13, further comprising a lamp attached to the attachment plate or bar.

15. The easel according to claim 1, wherein the at least one frame and workpiece supporting fixture are made of wood.

* * * * *